US005405033A

United States Patent [19]

Sweed

[11] Patent Number: 5,405,033

[45] Date of Patent: Apr. 11, 1995

[54] SAFETY DEVICE FOR CORKS

[76] Inventor: James R. Sweed, 5022 S. Willow Dr. #903, Houston, Tex. 77035

[21] Appl. No.: 116,508

[22] Filed: Sep. 7, 1993

[51] Int. Cl.[6] ..... B65D 55/16

[52] U.S. Cl. ..... 215/306; 215/271; 215/277; 215/279; 215/355; 215/100 R

[58] Field of Search ..... 215/271, 273, 277, 279, 215/293, 294, 306, 317, 355, 251, 254, 100 R; 220/260, 270, 287

[56] References Cited

U.S. PATENT DOCUMENTS

| | | | |
|---|---|---|---|
| 140,346 | 7/1873 | Chillingworth | 215/277 X |
| 1,654,720 | 1/1928 | Clark | 215/254 X |
| 1,979,706 | 11/1934 | Reamy | 220/287 |
| 2,080,108 | 5/1937 | Brandstein | 215/317 X |
| 3,232,469 | 2/1966 | Piazze | 215/251 |
| 3,392,860 | 7/1968 | Faulstich | 215/254 |
| 3,862,614 | 1/1975 | Kovac | 215/317 |
| 5,145,079 | 9/1992 | Woodrow et al. | 215/232 |

FOREIGN PATENT DOCUMENTS

| | | | |
|---|---|---|---|
| 440472 | 5/1925 | Germany | 215/277 |
| 2508563 | 9/1975 | Germany | 215/277 |

*Primary Examiner*—Allan N. Shoap
*Assistant Examiner*—Stephen Cronin
*Attorney, Agent, or Firm*—Harrison & Egbert

[57] ABSTRACT

A champagne bottle safety device having a bottle, a cork received within an open end of the bottle, and an elastic sheath extending over an exterior of the cork and extending around a portion of the bottle below the cork. The bottle has pressurized contents, such as champagne. The cork is received within the open end so as to contain the pressurized contents. The cork has a neck portion slidably and removably received within the open end of the bottle and a head portion extending outwardly of the open end. The elastic sheath covers the head portion. A foam insert is affixed to a top surface of the head portion. The elastic sheath extends over the foam insert. The elastic sheath has a closed end and an open end. The open end extends around a circumference of the bottle. The open end extends in air-tight relationship around this circumference of the bottle.

14 Claims, 2 Drawing Sheets

SAFETY DEVICE FOR CORKS

TECHNICAL FIELD

The present invention relates to corks for bottles, generally. More particularly, the present invention relates to devices for retaining and removing the cork in a safe manner from an open end of a bottle having pressurized contents.

BACKGROUND ART

One of the major causes of eye injury each year is errant flying corks from champagne bottles and other corked bottles having liquid contents under pressure. At serving temperature, the pressure in a champagne bottle is about ninety pounds per square inch, and a cork spontaneously ejected from a bottle after removal of the wire mesh cage attains a velocity of about forty-five feet per second when it strikes the eye. Since a cork traveling at this speed can reach the eye from a distance of two feet in less than 0.05 seconds, and as the blink reflex takes about 0.1 second, the cornea of the eye usually receives the full impact of the cork. The problem of eye injuries due to flying corks has been aggravated by the recent introduction of plastic stoppers for champagne bottles.

Although there is a preferred technique for removing corks from pressurized bottles, even waiters and waitresses who presumably are instructed in the proper technique suffer eye injuries from flying corks. While safety devices have been designed in the past to provide a protective stop against unlimited motion of a cork during removal, these devices usually employ awkward lever-type arrangements which are inconvenient to carry and somewhat cumbersome to use, particularly since most devices have long lever arms extending perpendicular to the axis of the bottle.

In the past, various U.S. patents have issued which relate to the safe removal of champagne bottle corks.

U.S. Pat. No. 4,875,394, issued on Oct. 24, 1989, to C. B. Crudgington, Jr. describes a champagne bottle opener which includes bifurcated jaws for removing the mushroom-shaped stoppers from champagne bottles. Each jaw contains a recess so as to enable the device to be repositioned directly around the stopper's stem and on top of the bottle when the stopper has been partially removed. Clips are provided to the upper jaw so as to prevent the stopper from ricocheting out from under the retaining arm. The retaining arm permits a downwardly directed and manually exerted counter force to be applied to the stopper so as to allow the stopper to be removed slowly.

U.S. Pat. Nos. 4,583,652, 4,573,602, and 4,564,114 have issued to J. R. Goldberg concerning a molded safety closure device for champagne bottles. This device includes a cylindrical closure element which fits within the mouth of the bottle and which is restrained from flying free of the bottle by a cylindrical retainer collar which fits around the neck of the bottle. The closure element is attached to the collar by a tether strip which is molded integrally with the closure element and the collar and which tears free thereof. The closure element is molded as a separate unitary structure and is secured mechanically by a snap fit around the periphery of one end of the closure element.

U.S. Pat. No. 4,527,450, issued on Jul. 9, 1985, to B. J. Drosky teaches a stopper extractor that includes a housing having an open end and a closed end and a side-facing cutout on one side of the housing wall with a grip disposed for axial movement within the housing. The side-facing cutouts are sized to allow the enlarged head of a stopper to be inserted laterally into the grip. The extractor is mounted over the stopper with the open end against the container and the grip lip under the lower edge of the cork head. A rocking of the handle will pivot a cam so as to raise the grip. This causes the open end to bear downwardly against the container and the grip to move axially upwardly within the housing to pull the cork from the container and into the housing.

U.S. Pat. No. 4,513,870, issued on Apr. 30, 1985, to E. Zaltsman provides a bottle with a one-piece cork. This device employs a tether which is molded into the cork. When the cork is removed from the bottle, an energy-absorbing link serves to prevent the cork from flying away from the bottle at high speeds.

U.S. Pat. No. 4,442,735, issued on Apr. 17, 1984, to Chance et al. describes a safety device for preventing the premature expulsion of a stopper from a champagne bottle. A body is provided having a top and downwardly extending opposed leg portions attached to the top. Each of the leg portions has upper and lower inner ledge portions. The upper ledge portion is positioned for engagement with the lower rim surface of the stopper. The lower edge portion is positioned to provide a limit stop with the lower surface of the neck ridge upon upward motion of the device.

U.S. Pat. No. 4,018,110, issued on Apr. 19, 1977, to S. C. Spriggs shows a hand manipulable device for removing bottle stoppers. This device includes upper and lower bifurcated jaws engagable around the neck of a bottle between the shoulder and mouth of the bottle for engagement of the upper jaw below the overhanging stopper head whereby a spreading of the jaws effects an upward withdrawal of the stopper. A retaining arm is fixed to the upper jaw and extends generally centrally thereover in outwardly spaced relationship thereto.

It is an object of the present invention to provide a safety device for champagne bottle corks which prevents the explosive ejection of the stopper.

It is another object of the present invention to provide a safety device for champagne bottle corks that is easy to use.

It is another object of the present invention to provide a safety device that cushions the impact of the champagne cork.

It is still a further object and advantage of the present invention to provide a safety device for champagne bottles which is easy to manufacture, easy to install, and relatively inexpensive.

These and other objects and advantages of the present invention will become apparent from a reading of the attached specification and appended claims.

SUMMARY OF THE INVENTION

The present invention is a champagne bottle safety device that comprises a bottle, a cork received within an open end of the bottle, and an elastic sheath extending over an exterior of the cork and extending around a portion of the bottle below the cork.

The bottle contains pressurized contents. The cork is received within the open end of the bottle so as to contain the pressurized contents within the bottle. Specifically, the bottle is a champagne bottle which contains champagne. The cork is a plastic cork which is retained within the champagne bottle.

The cork specifically comprises a neck portion slidably received within the open end of the bottle, and a head portion which extends outwardly of the open end. The elastic sheath extends around the head portion. The head portion has a foam insert which is affixed to a top surface or extends around and over the head portion thereof. The elastic sheath extends over and covers the foam insert. The head portion has a diameter greater than the open end of the bottle.

The elastic sheath has a closed end and an open end. The closed end extends over the cork. The open end extends around a circumference of the bottle. The open end has a rolled bottom. The rolled bottom is movable between a first position adjacent the open end of the bottle and a second position distal the open end. The second position has a greater diameter than the first position. The open end has a tab affixed thereto. The closed end covers a top of the cork and extends continuously therefrom to the open end. The open end extends in air-tight relationship around the circumference of the bottle. A textured surface can be provided in the elastic sheath at the open end so as to provide extra cling to the bottle.

DETAILED DESCRIPTION OF THE INVENTION

Figure 1:
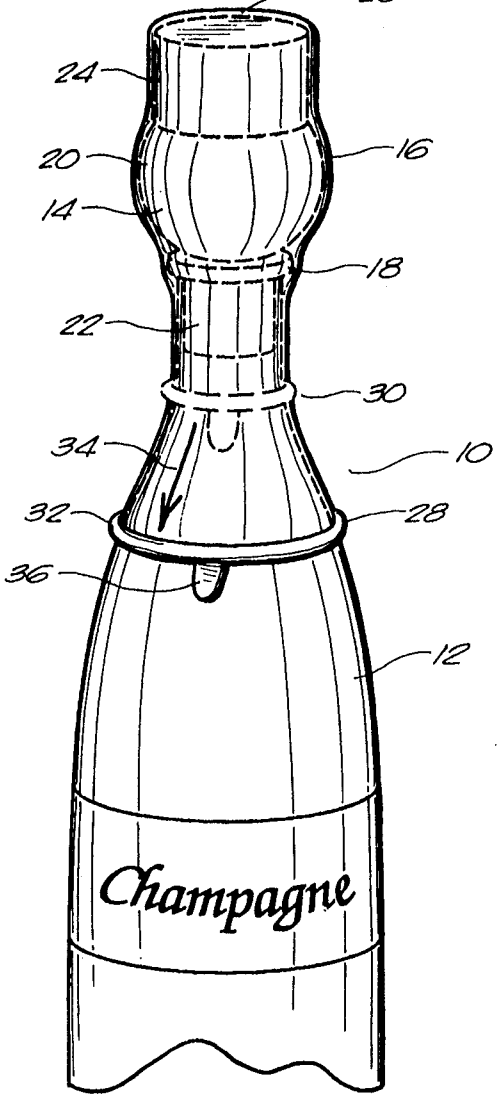
FIG. 1 is a side elevational view of the safety device in accordance with the preferred embodiment of the present invention.

Referring to FIG. 1, there is shown at 10 the champagne bottle safety device in accordance with the preferred embodiment of the present invention. The device 10 includes a bottle 12, a cork 14, and an elastic sheath 16. As can be seen in FIG. 1, the cork 14 is received within the open end 18 of the champagne bottle 12. The cork 14 is received within this open end 18 in a conventional fashion. The elastic sheath 16 extends over an exterior of the cork 14 and extends around a portion of the bottle 12 below the cork.

Specifically, the bottle 12 is a bottle which contains pressurized contents. Specifically, the bottle 12 is a champagne bottle. It is important to realize, however, that the present invention is applicable to various bottles that contain other pressurized liquids.

The cork 14 is a conventional plastic cork that is retained within the bottle 12. The cork 14 has a head portion 20 and a neck portion 22. The neck portion 22 is slidably and removably received within the open end 18 of the bottle 12. The head portion 20 extends outwardly of the open end 18 of the bottle 12. The elastic sheath 16 extends around the head portion 20.

In FIG. 1, it can be seen that a foam insert 24 is affixed to the top surface of the head portion 20 of cork 14. The foam insert may, alternatively, be affixed in an end of the elastic sheath 16. The elastic sheath 16 extends over the top of and around the foam insert 24. The foam insert 24 is of a closed cell foam material. In the preferred embodiment of the present invention, the foam insert 24 can be affixed to the top surface of the head portion 20 or it can be positioned in abutment with the top surface 20. In essence, the foam material 24 serves as an additional safety feature. The foam insert 24 is designed to cushion the plastic cork should the elastic sheath 16 become dislodged or fail to function properly. In FIG. 1, it can be seen that the head portion 20 has a diameter greater than that of the open end 18 of the bottle 12.

The elastic sheath 16 has a closed end 26 and an open end 28. As can be seen, the closed end 26 extends over the foam insert 24 and over the head portion 20 of the cork 14. On the other hand, the open end 28 extends around a circumference of the bottle 12. It can be seen that the open end 28 has a rolled bottom. As illustrated in FIG. 1, the rolled bottom 28 is movable from a first position 30 adjacent to the open end 18 of bottle 12 and a second position 32 which is distal the open end 18. The arrow 34 in FIG. 1 indicates the direction of movement of the rolled bottom 28 between the first position 30 and the second position 32. The open end 28 has a greater diameter at the second position 32 than it does in the first position 30. The rolled bottom 28 includes a tab 36 which is affixed thereto. The tab 36 can include a matching tab positioned on the other side of the bottle. The tab 36 can be used so as to move the rolled bottom 28 from the first position 30 to the second position 32.

As can be seen, the elastic sheath 16 extends continuously from the closed end 26 to the open end 28. The open end 28 extends in air-tight juxtaposition around the circumference of the bottle 12. The sheath 16 can be made of an elastic synthetic material.

Figure 2:
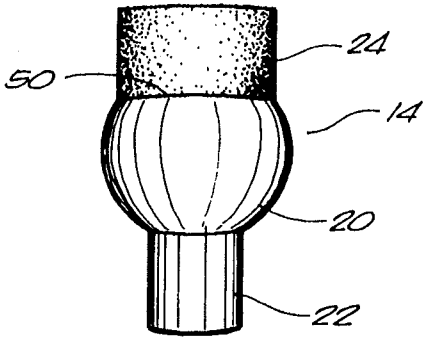
FIG. 2 is an isolated side elevational view of the cork in accordance with the preferred embodiment of the present invention.

FIG. 2 shows the cork 14 as isolated from the bottle 12. The cork 14 includes a neck portion 22 and a head portion 20. The foam insert 24 is affixed to the top surface 50 of the head portion 20. The neck portion 22 is slidably received within the open end 18 of the champagne bottle 12. Conventionally, the neck portion 22 tapers somewhat outwardly so as to assure a tight fit between the inside walls of the neck of the bottle 12 and the exterior surface of the neck 22 of the cork 14. The head portion 20 has a generally rounded configuration and a diameter which is greater than that of the opening 18 of the bottle 12. The head portion 20 has a greater diameter than that of the neck portion 22. Normally, during the removal of the cork 14, the person opening the bottle will grab the head portion 20 so as to properly remove the cork 14 from the bottle 12.

The foam insert 24 may be affixed to the top surface 50 of the head portion 20 by adhesives or by mechanical mounting techniques. Alternatively, if it is desired to retain the conventional configuration of the cork 14 after the bottle has been opened, the foam insert 24 may be simply positioned on the top surface 50, rather than attached. The foam insert 24 will provide a cushion should the cork 14 explosively release from the champagne bottle 12.

Figure 3:
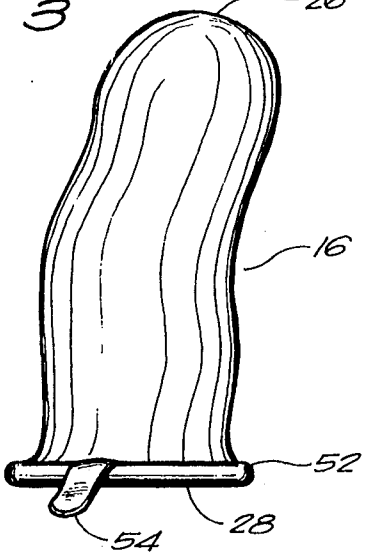
FIG. 3 is an isolated view of the elastic sheath used in the present invention.

FIG. 3 is an isolated view of the sheath 16. The sheath 16 is made of a stretchable elastic material. As can be seen, the sheath 16 includes a closed end 26 and an open end 28. The open end 28 has a rolled bottom 52. A tab 54 extends outwardly from the rolled bottom 52. During times of application, the tab 54 may be grasped so as to assist in the movement of the rolled bottom 52 from the first position 30 to the second position 32. The elastic sheath 16 will have an unexpanded diameter less than the diameter of the champagne bottle 12. During the movement of the rolled bottom 52 along the outer diameter of the champagne bottle 12, the diameter of the open end 28 will expand so as to fit, in air-tight relationship, the circumference of the champagne bottle 12.

Figure 4:
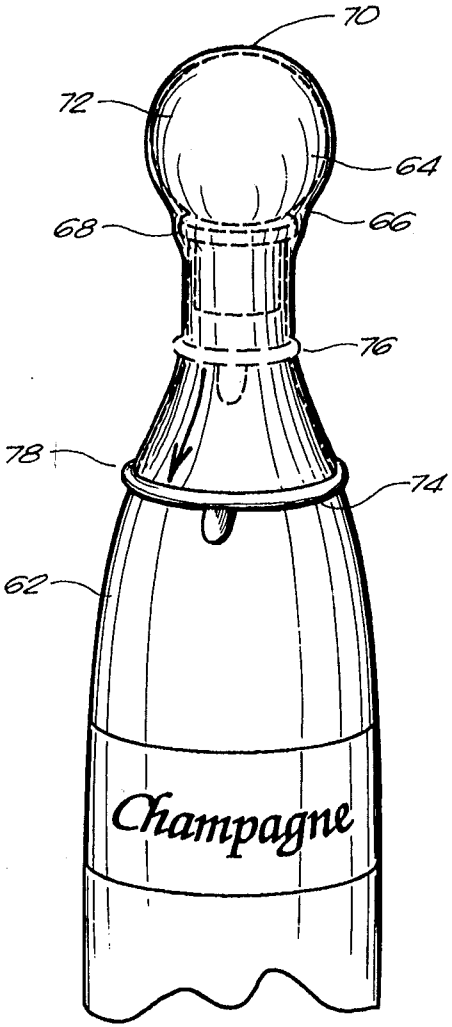
FIG. 4 is a side elevational view of an alternative embodiment of the safety device of the present invention.

FIG. 4 shows an alternative embodiment 60 of the champagne bottle safety device of the present invention. Essentially, the alternative embodiment 60 is similar to that described in FIG. 1, with the notable exception of the foam insert 24. Specifically, the device 60 includes the champagne bottle 62, the cork 64, and the elastic sheath 66. The cork 64 is received within the open end 68 of the champagne bottle 62 in a conventional fashion. The elastic sheath 66 includes a closed end 70 which covers the top surface and sides of the head portion 72 of the cork 64. The sheath 66 includes an open end 74 which extends around the circumference of the champagne bottle 62. As can be seen, the open end 64 is movable between the first position 76 and the second position 78. In application, the cork 64 is securely received on the interior of the closed end 70 of the elastic sheath 66.

The present invention is adapted to champagne bottles so as to keep the cork from flying off and the contents of the champagne bottle from spilling. Since the diameter of the open end 74 of the sheath 66 is less than the diameter of the bottle, the open end 74 will cling to the bottle in generally air-tight relationship. When the cork 64 is dislodged, the cling of the sheath 66 to the exterior surface of the bottle 62, plus the tension of the material of the elastic sheath 66, will keep the cork 64 from flying off. The air-tight relationship between the open end 74 and the exterior of the bottle 62 also keeps the contents of the bottle 62 from foaming and spilling.

If the entire sheath should become dislodged, then the foam insert on the top of the cork 14 or in the closed end of the sheath 16 will cushion the cork 14 if it did hit an object. The foam insert 24 serves to greatly reduce the impact of the flying cork.

Figure 5:
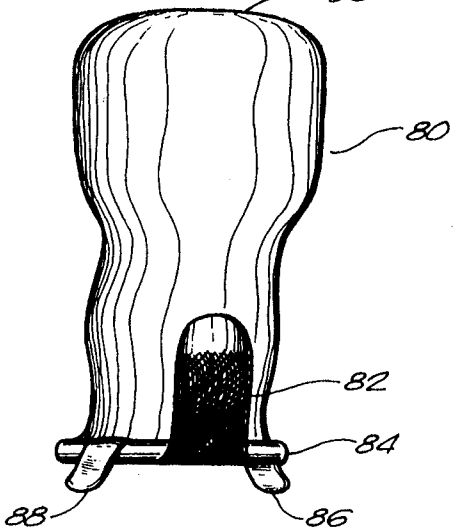
FIG. 5 shows an isolated view of the elastic sheath having a textured bottom interior surface.

FIG. 5 shows an alternative view of the elastic sheath 80 as isolated from the cork and the champagne bottle. The elastic sheath 80 has a configuration similar to the elastic sheath in the aforedescribed embodiments. Most importantly, the elastic sheath includes a textured surface 82 formed on the interior of the sheath so as to provide for extra clinging power between the sheath 80 and the surface of the champagne bottle. It can be seen that the sheath 80 has a rolled bottom 84 and tabs 86 and 88 extending from opposite sides of the rolled bottom 84. The elastic sheath 80 includes a cover portion 90 which will extend over the head portion of the cap.

Figure 6:
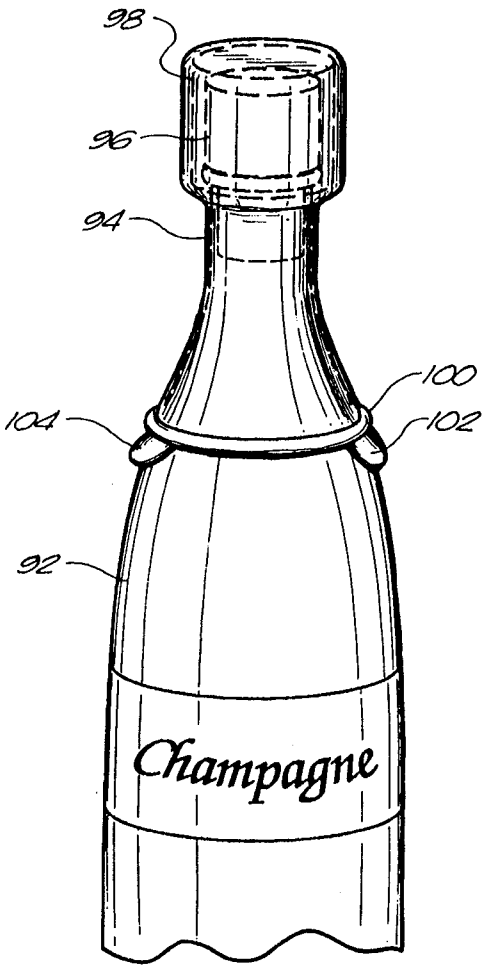
FIG. 6 shows an alternative embodiment in which the foam cap covers the head portion of the cork.

FIG. 6 shows an alternative embodiment of the present invention that includes the champagne bottle 92, the elastic sheath 94, the cork 96, and a foam cap 98. It can be seen that the foam cap 98 extends over and around the outer surfaces of the head portion of the cork 96. The elastic sheath 94 will extend over the exterior surface of the foam cap 98 and is adhered by its rolled bottom 100 to the outer surface of the champagne bottle 92. Tabs 102 and 104 extend below the rolled bottom 100.

Figure 7:
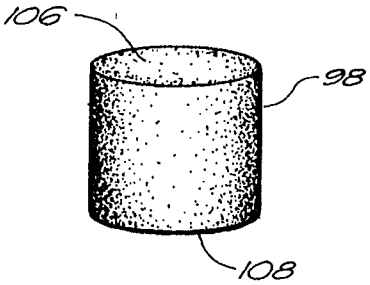
FIG. 7 is a perspective view of the foam cap.

The foam cap 98 is fitted over the head portion of the cork 96 and extends down below the head portion of the cork 96 such that the bottom end of the foam cap 98 resides slightly below the opening of the champagne bottle 92. This foam cap has a solid top which covers the top surface of the cork 96. The foam cap 98 is illustrated in greater detail in FIG. 7. In FIG. 7, it can be seen that the foam cap 98 has a solid top 106 and an open bottom 108. The open bottom 108 is sized so as to fit over the cork 96 of the champagne bottle 92. The top surface of the head portion of the cork 96 will lie in abutment with the bottom surface of the top 106 of the foam cap 98.

The foam cap 98 serves for a child's safety since the foam material will cover the top of the cork and the top of the bottle. The foam material prevents the top from being twisted open by a small child. The foam material of the foam cap 98 is fitted within the elastic sheath 94.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus comprising:

a bottle;

a cork received within an open end of said bottle; and an elastic sheath extending over an exterior of said cork and extending in air-tight relationship around a circumference of said bottle below said cork, said elastic sheath having a lower portion, said lower portion having an expanded diameter, prior to placement on said bottle, less than said circumference of said bottle below said cork.

2. The apparatus of claim 1, said bottle having pressurized contents, said cork received within said open end so as to contain the pressurized contents.

3. The apparatus of claim 2, said bottle being a champagne bottle containing champagne.

4. The apparatus of claim 3, said cork being a plastic cork retained within said champagne bottle.

5. The apparatus of claim 1, said cork comprising:

a neck portion slidably and removably received within said open end of said bottle; and a head portion extending outwardly of said open end, said elastic sheath extending so as to cover said head portion.

6. The apparatus of claim 5, said head portion having a foam insert affixed to a top surface thereof, said elastic sheath extending over said foam insert.

7. The apparatus of claim 5, said head portion having a diameter greater than said open end of said bottle.

8. The apparatus of claim 1, said elastic sheath having a closed end extending over said cork.

9. The apparatus of claim 8, said open end having a rolled bottom, said rolled bottom movable between a first position adjacent said open end of said bottle and a second position distal said open end, said rolled bottom having a greater diameter at said second position than at said first position.

10. The apparatus of claim 8, said open end having a tab affixed thereto.

11. The apparatus of claim 8, said closed end covering a top of said cork and extending continuously therefrom to said open end, said elastic sheath having a textured inner surface so as to provide for greater friction with a surface of said bottle.

12. An apparatus comprising:

a bottle;

a cork received within an open end of said bottle; and an elastic sheath extending over an exterior of said cork and extending around a circumference of said bottle below said cork, said elastic sheath having an open end in air-tight juxtaposition with said circumference of said bottle, said open end of said elastic sheath having an, prior to placement on said bottle, less than said circumference, said elastic sheath being of a synthetic material.

13. The apparatus of claim 12, said open end having a rolled bottom, said rolled bottom movable between a first position adjacent said open end of said bottle and a second position distal said open end, said rolled bottom having a greater diameter at said second position than at said first position.

14. The apparatus of claim 12, said closed end covering a top of said cork and extending continuously therefrom to said open end.

* * * * *